US007168691B2

(12) United States Patent
MacLaren

(10) Patent No.: US 7,168,691 B2
(45) Date of Patent: Jan. 30, 2007

(54) WATER RESISTANT AERATOR SYSTEM AND METHOD

(76) Inventor: David S. MacLaren, 6805 Mayfield Rd., Apt. 1525, Mayfield, OH (US) 44124

( * ) Notice: Subject to any disclaimer, the term of this patent is extended or adjusted under 35 U.S.C. 154(b) by 36 days.

(21) Appl. No.: 10/961,566

(22) Filed: Oct. 8, 2004

(65) Prior Publication Data

US 2005/0151279 A1 Jul. 14, 2005

Related U.S. Application Data

(60) Provisional application No. 60/510,512, filed on Oct. 10, 2003.

(51) Int. Cl.
*B01F 3/04* (2006.01)

(52) U.S. Cl. ..... 261/87; 261/91; 261/93

(58) Field of Classification Search ..... 261/84, 261/87, 91, 93

See application file for complete search history.

(56) References Cited

U.S. PATENT DOCUMENTS

| | | | | |
|---|---|---|---|---|
| 2,591,440 | A * | 4/1952 | Kollsman | 261/93 |
| 3,400,918 | A * | 9/1968 | MacLaren | 261/87 |
| 4,539,498 | A * | 9/1985 | Wilkes | 310/87 |
| 4,608,157 | A * | 8/1986 | Graves | 210/86 |
| 4,844,843 | A * | 7/1989 | Rajendren | 261/30 |
| 4,950,133 | A * | 8/1990 | Sargent | 417/312 |
| 5,160,667 | A * | 11/1992 | Gross et al. | 261/91 |
| 5,183,596 | A * | 2/1993 | Rajendren et al. | 261/93 |
| 5,316,668 | A | 5/1994 | Tang | |
| 5,484,524 | A | 1/1996 | MacLaren | |
| 5,851,443 | A * | 12/1998 | Rajendren | 261/87 |
| 2002/0102164 | A1 * | 8/2002 | Osadchuk | 417/234 |
| 2005/0073204 | A1 * | 4/2005 | Puterbaugh et al. | 310/89 |

OTHER PUBLICATIONS

Jet, Inc. Owner's Manual: 1500 Series BAT Media Plants. Feb. 2003, Jet, Inc., Cleveland, OH.

* cited by examiner

*Primary Examiner*—Scott Bushey
(74) *Attorney, Agent, or Firm*—Roberts Mardula & Wertheim, LLC

(57) ABSTRACT

The water resistant aerator design of the present invention includes a combination of known waterproofing techniques with new techniques for wastewater aerators comprising: use of a threaded joint and thread sealing compound between the lifting handle and the top endbell to provide a watertight connection between the parts; use of a single lip seal for the top lip seal that has over 18 degrees of wear motion before pressure is lost; use of a grease seal between the top lip seal and the top bearing to impede moisture from entering the motor; use of a grease seal between the bottom lip seal and the bottom bearing to impede moisture from entering the motor; use of a multi-surface silicone sealant between the bottom endbell and the air seal enclosure to provide a watertight joint that prevents water from entering the air seal enclosure; and use of an O-ring seal between the endbells and the stator shell.

14 Claims, 3 Drawing Sheets

WATER RESISTANT AERATOR SYSTEM AND METHOD

RELATED APPLICATIONS

The present application claims priority to U.S. Provisional Application Ser. No. 60/510,512, filed Oct. 10, 2003, which is hereby incorporated by reference for all purposes.

FIELD OF THE INVENTION

The present invention relates generally to a water resistant aerator. In particular, the present invention is directed toward an aerator, and methods for waterproofing the same, used for sewage and wastewater treatment that uses various waterproofing elements to prevent damage caused by flooding of the treatment plant and other aqueous sundries.

BACKGROUND

Various techniques have been used in the treatment of wastewater. U.S. Pat. No. 5,316,668 to Tang discloses a wastewater treatment plant comprising a pretreatment chamber, aeration chamber and a settling chamber designed to minimize or eliminate sludge buildup at the bottom of the aeration chamber. In Tang, two support walls are provided. The combined function of one support wall and an angular portion at the bottom of the common wall, between the aeration and settling chamber, regulates the flow pattern in the aeration chamber and returns settled biodegradable matter from the bottom of the settling chamber to the aeration chamber for further treatment. The fluid flow created by the wall structure enhances the action of the settling chamber and eliminates dead zones in the aeration chamber thus minimizing sludge buildup.

In another example of wastewater treatment, U.S. Pat. No. 5,484,524 to MacLaren et al. discloses a similar wastewater treatment plant for removal of organic matter. In this patent, suspended solids and other pollutants comprising a pretreatment chamber, a biofilm-aeration chamber and a settling chamber. Biofilm grows on a biofilm support structure that is stationary and submerged in the mixed liquor of the biofilm aeration chamber. The combination of submerged or surface aeration and suspended solid particle size reduction occurs, thereby creating a sufficient fluid flow within the biofilm aeration chamber. In this combination of sufficient fluid flow and reduced particle size, suspended organic particles and pollutants are efficiently digested by the biofilm. This results in an effective digestive process that produces no sludge. Further, the resulting effluent has a high level of dissolved oxygen, which is desirable, as well as a low biochemical oxygen demand (BOD) and suspended solids (SS).

This type of treatment system provides effective wastewater treatment before effluent is discharged to an appropriate disposal area. This is essential, since in many parts of the country, disinfected effluent is discharged directly to open drainage ditches or streams. For example, the JET series 1500 treatment system, available from JET Inc. of 750 Alpha Dr. Cleveland, Ohio, is used in such applications. The JET system has been rigorously tested by the National Sanitation Foundation and found to achieve a NSF 40 Class 1 effluent quality, i.e., an effluent quality consistently better than 30 mg/L BOD and 30 mg/L total suspended solids (TSS). This system is particularly well suited for use where small lots, high groundwater, and/or poor soils are encountered.

In operation, the JET system utilizes a motor driven aspirator shaft that thoroughly mixes and disperses fine air bubbles into the aerobic chamber of the treatment tank. This is an activated sludge system, which uses both suspended and fixed growth bacteria to achieve secondary biological treatment. The aeration chamber capacity of 650 gallons for the above-mentioned JET system allows a detention time of more than 30 hours at design flow of 500 gallons per day. Larger systems can handle higher flows. The benefits of such systems include: superior effluent quality, dramatically reduced need for further wastewater treatment; reduced leaching area, or direct effluent discharge after disinfection; decreased separation to groundwater; effective use of poor soil conditions; and increased the life expectancy of the leach area due to discharge of high quality effluent.

In these types of wastewater treatment systems, the primary moving part is the motor driven aerator. If water enters the motor, it causes damage resulting in the need to repair the aerator or replace the system. Water damage can occur when the water level in the tank rises to a point where it contacts the aerator, which occurs most frequently when there is a blockage of the tank outlet. Although one method to avoid water damage caused by outlet blockage is the installation of an overflow valve, use of these valves is not always possible and, even when used, these valves are subject to blockage and can be overwhelmed by heavy flooding.

FIG. 1 shows a typical aerator design of the prior art. In this system there are multiple locations where leakage can occur, at sites 1–4. The seal 1 between the top enclosure and the top endbell is a major leak point in this type of aerator. During a flood of the plant, water rises through the aspirator, aspirator shaft and rotor shaft and spills over the top of the rotor shaft. The rubber disk that seals between the top enclosure and the top endbell does not seal around the rotor shaft. This provides an open path for liquid to run freely into the interior of the motor.

The thru bolts 2 are another leak point in this type of aerator. When liquid rises to the level of the top of the top endbell, liquid runs between the top enclosure and the top endbell and enters the cavities around the thru bolt heads and drains into the motor. Another area prone to leakage is the point 3 between the endbells and the stator shell. Yet another leak point is the lower seal 4. When the seal 4 wears down, as it always will, it will begin to leak air out of the air seal enclosure, negating the diving bell effect and providing another leak point.

What is needed is a water resistant aerator that resists leaking and water damage, making the aerator longer lasting, less prone to damage from blockage, and more resilient to wet environments.

SUMMARY OF THE INVENTION

The water resistant aerator design of the present invention comprises a combination of waterproofing techniques for wastewater aerators, including but not limited to: use of a threaded joint and thread sealing compound between the lifting handle and the top endbell to provide a watertight connection between the parts; use of a single lip seal for the top lip seal that has over 18 degrees of wear motion before pressure is lost; use of a grease seal between the top lip seal and the top bearing to impede moisture from entering the motor; use of a grease seal between the bottom lip seal and the bottom bearing to impede moisture from entering the motor; use of a multi-surface silicone sealant between the bottom endbell and the air seal enclosure to provide a watertight joint that prevents water from entering the air seal enclosure; and use of an O-ring seal between the endbells and the stator shell.

This combination leads to a water resistant aerator that achieves more than an incremental improvement over the prior art than simply the sum of individual contributions.

DETAILED DESCRIPTION OF THE INVENTION

Figure 1:
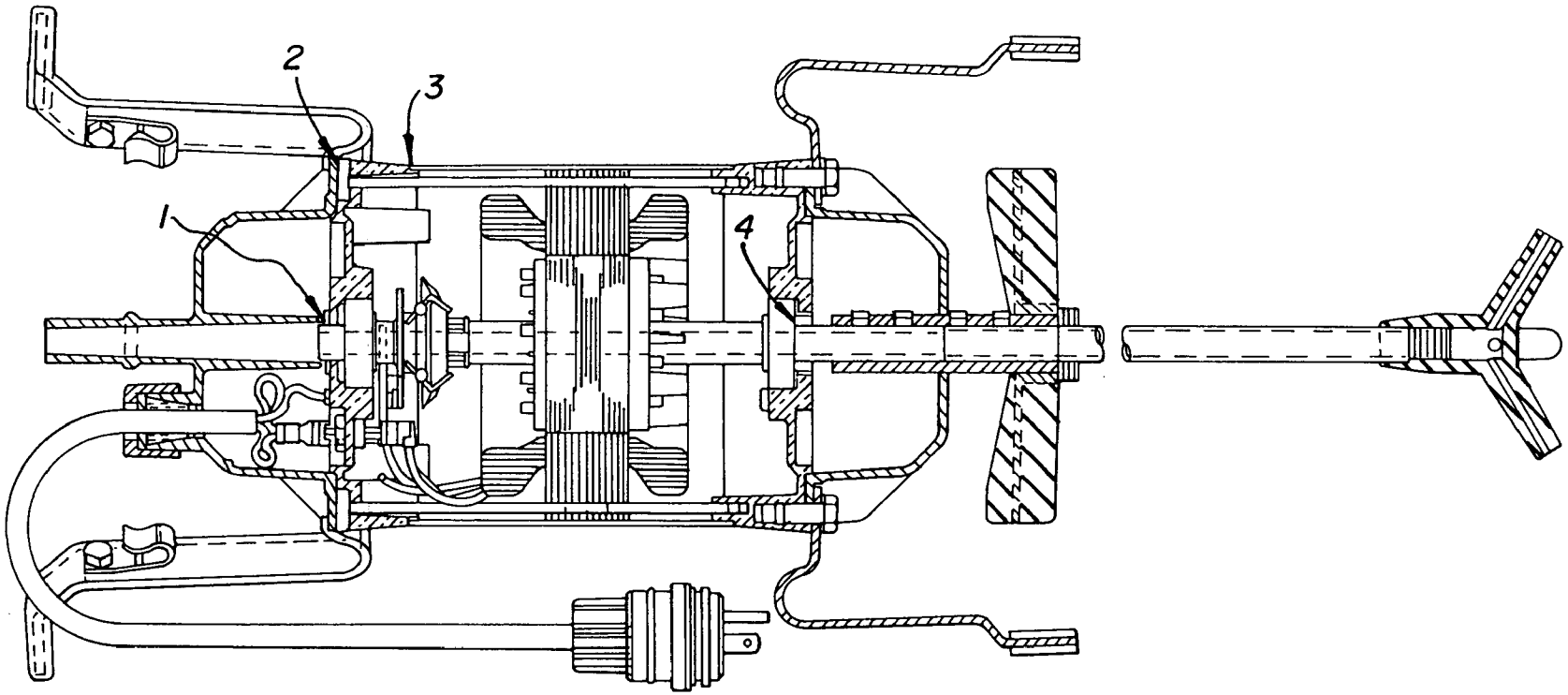
FIG. 1 PRIOR ART
FIG. 1 illustrates a prior art aerator design.

In one embodiment of the present invention, a water resistant aerator and a method for waterproofing it includes an air inlet cover over an air inlet plate to collect the aeration air. For the body of the aerator, a top endbell is attached to a top end of a stator shell and a bottom endbell is attached to a bottom end of the stator shell. A motor is enclosed within the body and a hollow rotor shaft is mounted on a top bearing in the top endbell and a bottom bearing in the bottom endbell. The rotor shaft is coupled to the inlet plate at a first end, passes through the top endbell to the motor and from the motor through the bottom endbell where it is coupled to an aspirator shaft at a second end. An air seal enclosure is located between the bottom endbell and the rotor shaft.

For waterproofing, the water resistant aerator further comprises top and bottom lip seals between the endbells and the rotor shaft, the lip seals each being a single lip seal with at least 18 degrees of wear motion before pressure is lost. A grease seal is located between each lip seal and each bearing. A multi-surface silicone sealant is applied between the bottom endbell and the air seal enclosure. O-ring seals can be located between the top and bottom endbells and the stator shell.

At the upper portion of the aerator, a lifting handle couples the rotor shaft to the air inlet plate, where the lifting handle includes a threaded attachment to the top endbell and the threaded attachment includes a thread sealing compound. Additionally, two or more of the bolts are used to secure a periphery of the top and bottom endbells to each other, where the bolts are located outside the stator shell so as not to introduce through-holes that can leak.

Preferably, the top and bottom bearings are pre-lubricated sealed bearings that have a running seal on either side. To prevent the drawing of water droplets into the aerator, the air inlet plate preferably has openings with a combined cross-sectional area 4½ times larger than the cross-sectional area of the hollow portion of the rotor shaft. Also, locating the air inlet plate 1/16" (1.6 mm) below the air inlet cover helps keep insects and other debris out of the aerator.

Figures 2, 3:
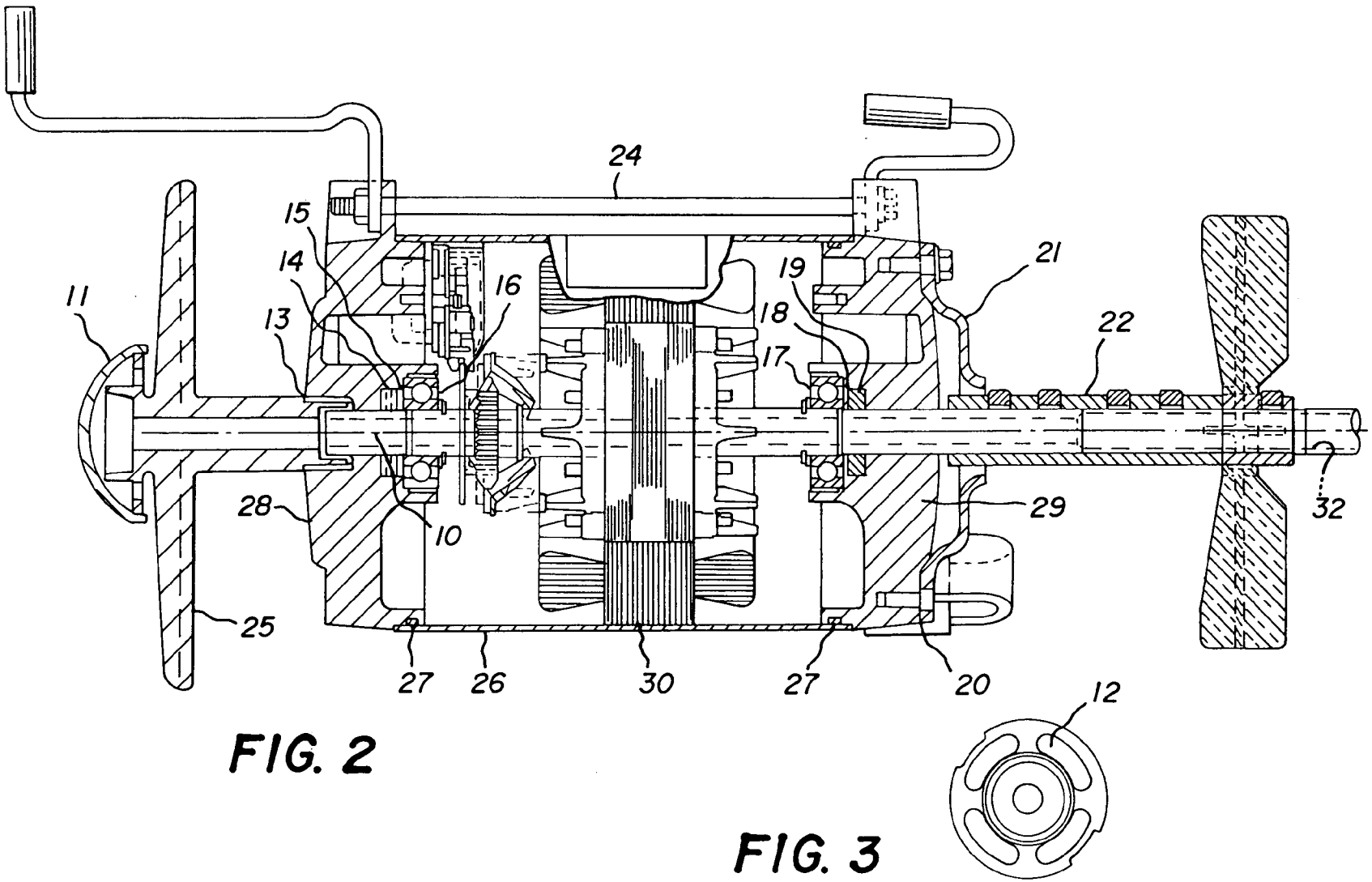
FIG. 2 illustrates one embodiment of a water resistant aerator according to the present invention.
FIG. 3 illustrates one embodiment of an air inlet plate of a water resistant aerator according to the present invention.

FIG. 2 illustrates a cross sectional view one embodiment of the water resistant aerator of the present invention. In use, aeration air enters through an air inlet cover 11 through an air inlet plate 12 to a hollow rotor shaft 10. The rotor shaft 10 passes through a top endbell 28 to the motor 30 and, from the motor 30, though a bottom endbell 29 to feed air to an aspirator shaft 32 coupled thereto by coupling 22. The rotor shaft 10 is mounted via bearings 16, 17 in each endbell 28, 29 and has a seal 15, 18 associated with each endbell.

Figure 4:
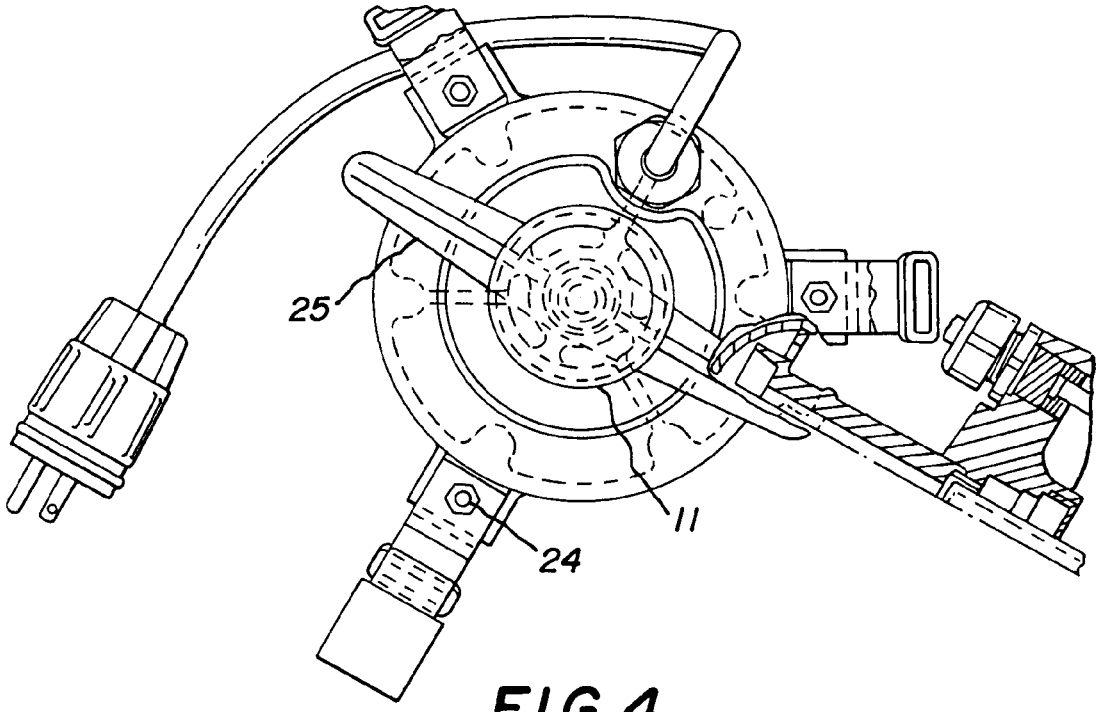
FIGS. 4–5 illustrate end views a water resistant aerator according to one embodiment of the present invention.
Figure 5:
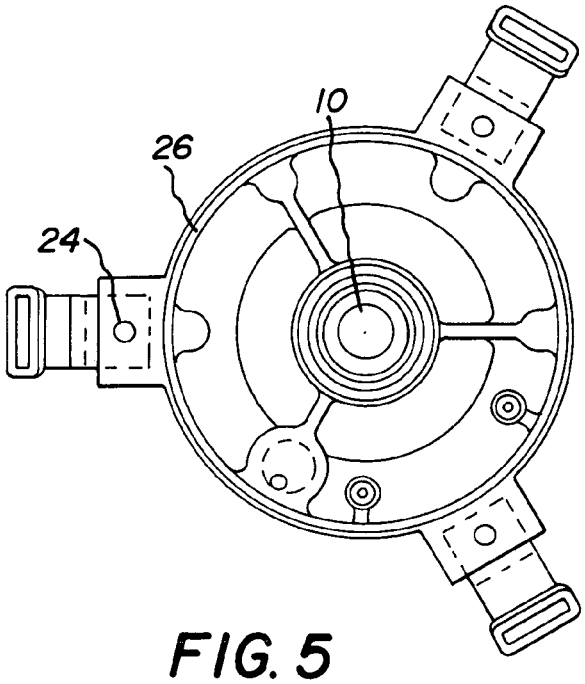

Various waterproofing details are provided in the present invention to allow the aerator to be more water resistant. The air inlet cover 11 prevents any water that can enter through a vent from entering the aerator. As shown in FIGS. 3 and 4, the air inlet plate 12 above the handle 25 has openings that are about 4½ times the area of the opening in the rotor shaft 10. This results in low velocity air intake that is unlikely to pull in moisture droplets or airborne objects. The top of the air inlet is only 1/16" (1.6 mm) below the air inlet cover to further prevent objects and insects from entering the rotor and aspirator shafts. FIG. 5 illustrates the other end of the water resistant aerator shown in FIG. 2.

The threaded joint 13 between the lifting handle 25 and the top endbell 28 has a thread sealing compound applied to provide a watertight connection between these two parts.

The top lip seal 14 is a single lip seal with over 18 degrees of wear motion before pressure is lost. At that point, a very large seal to shaft surface interface exists to impede the flow of moisture into the motor's interior. As illustrated in FIG. 2, O-rings 27 can be provided between the endbells 28, 29 and the stator shell 26 to waterproof the joints. Although illustrated with two O-rings, it is possible that the stator shell 26 can be integrated with one of the endbells 28, 29 so that only a single O-ring is required.

A grease-filled space, also referred to as a grease seal 15, is provided between the top lip seal 14 and the top bearing 16 to impede moisture from entering the motor 30. Similarly, there is another grease seal 18 provided between the bottom bearing 17 and the bottom lip seal 19 to impede moisture from entering the motor 30. The top bearing 16 is a sealed bearing. This top bearing 16 has a running seal on either side, is pre-lubricated, and moisture cannot pass through. Likewise, the bottom bearing 17 is a sealed bearing. The bottom bearing 17 also has a running seal on either side and is pre-lubricated such that moisture cannot pass through the bearing.

The bottom lip seal 19 is a single lip seal with over 18 degrees of wear motion before pressure is lost. At that point a very large seal-to-shaft surface interface exists to impede the flow of moisture into the motor's interior. Multi-surface silicone sealant provides a watertight joint 20 between the bottom endbell 29 and the air seal enclosure 21 to prevent water from entering the air seal enclosure 21. The air seal enclosure 21 provides a pocket of trapped air like a diving bell that prevents the tank liquid from ever reaching the bottom of the aerator. The entire aerator is preferably painted on the exterior to further seal all joints and give enhanced corrosion resistance, although this is not a requirement.

The bolts 24 extending between the top and bottom endbells 28, 29 of the present invention are located outside of the stator shell 26 so that they no longer act as a potential leak site.

The only place where liquid can reach the interior of the motor is if the liquid level of the tank being aerated rises during a flood to the point that it comes up through the aspirator, aspirator shaft 32, and rotor shaft 10 to spill out over the top of the rotor shaft 10. In one embodiment, this flood point is 9¾" (24.8 cm) above the top of the tank interior and 21¾" (55.2 cm) above the normal operating level of the plant. However, even if flooding occurs to that level, moisture entry into the electrical interior of the motor 30 will be prevented by the lip seal 14, the grease seal 15, and the sealed bearing 16.

In one embodiment, the present invention comprises a water resistant aerator that has an air inlet cover over an air inlet plate, a top endbell attached to a top end of a stator shell and a bottom endbell is attached to a bottom end of the stator shell. A motor is enclosed by the top and bottom endbells and the stator shell. A hollow rotor shaft is mounted on a top bearing in the top endbell, and a bottom bearing in the bottom endbell. The rotor shaft is coupled to the inlet plate at the first end, and passes through the top endbell to the motor and from the motor through the bottom endbell where it is coupled to an aspirator shaft at the second end. There is also an air seal enclosure between the bottom endbell and the rotor shaft.

The water resistant aerator also comprises one or more waterproofing elements such as a top lip seal between the top endbell and the rotor shaft, the top lip seal being a single lip seal with at least 18 degrees of wear motion before pressure is lost. Another waterproofing element may include a grease seal between the top lip seal and the top bearing, and/or a bottom lip seal between the bottom endbell and the rotor shaft, the bottom lip seal being a single lip seal with at least 18 degrees of wear motion before pressure is lost. Another element may be a grease seal between the bottom lip seal and the bottom bearing, and/or a multi-surface silicone sealant applied between the bottom endbell and the air seal enclosure.

In one embodiment the water resistant aerator also has O-ring seals located between the top and bottom endbells and the stator shell.

In another embodiment the water resistant aerator includes a lifting handle coupling the rotor shaft to the air inlet plate, where the lifting handle includes a threaded attachment to the top endbell and the threaded attachment includes a thread sealing compound.

In still another embodiment the water resistant aerator further comprises two or more bolts securing a periphery of the top and bottom endbells to each other, where the bolts are located outside the stator shell.

In one embodiment the water resistant aerator the top and bottom bearings are pre-lubricated sealed bearings having a running seal on either side.

In another embodiment the water resistant aerator, the air inlet plate has openings with a combined cross-sectional area at least 4½ times larger than the cross-sectional area of the hollow portion of the rotor shaft.

In still another embodiment the water resistant aerator, the air inlet plate being located 1/16" below the air inlet cover.

In another embodiment the present invention provides a method of waterproofing a wastewater aerator. The method comprises providing an air inlet cover over an air inlet plate and attaching a top endbell to a top end of a stator shell. A bottom endbell is attached to a bottom end of the stator shell and a motor is enclosed with the top and bottom endbells and the stator shell. A hollow rotor shaft is mounted on a top bearing in the top endbell and a bottom bearing in the bottom endbell. The rotor shaft is coupled to the inlet plate at a first end, and the rotor shaft is passed through the top endbell to the motor and from the motor through the bottom endbell where it is further coupled to an aspirator shaft at a second end. An air seal enclosure between the bottom endbell and the rotor shaft is provided.

The method further comprises waterproofing the aerator by one or more methods such as sealing the top endbell and the rotor shaft with a single lip seal with at least 18 degrees of wear motion before pressure is lost. Another water proofing method includes sealing, between the top lip seal and the top bearing, with a grease seal, and/or sealing between the bottom endbell and the rotor shaft with a single lip seal with at least 18 degrees of wear motion before pressure is lost. Still another water proofing method is sealing between the bottom lip seal and the bottom bearing with a grease seal. Also applying a multi-surface silicone sealant between the bottom endbell and the air seal enclosure, and painting an exterior surface of the aerator.

In one embodiment the method includes providing O-ring seals located between the top and bottom endbells and the stator shell.

In another embodiment the method further comprises coupling the rotor shaft to the air inlet plate with a lifting handle, further comprising attaching the lifting handle to the top endbell with a threaded attachment and sealing compound.

In still another embodiment the method includes securing a periphery of the top and bottom endbells to each other with two or more bolts, where the bolts are located outside the stator shell.

In one embodiment the method further comprises pre-lubricating the sealed bearings and running a seal on either side for the top and bottom bearings.

In another embodiment the method provides openings in the air inlet plate having a combined cross-sectional area at least 4½ times larger than the cross-sectional area of the hollow portion of the rotor shaft.

In still another embodiment, the method further comprises locating the air inlet plate 1/16" below the air inlet cover.

A system and method for creation and use of a water resistant aerator has been described. It will be understood by those skilled in the art that the present invention may be embodied in other specific forms without departing from the scope of the invention disclosed and that the examples and embodiments described herein are in all respects illustrative and not restrictive. Those skilled in the art of the present invention will recognize that other embodiments using the concepts described herein are also possible. Further, any reference to claim elements in the singular, for example, using the articles "a," "an," or "the" is not to be construed as limiting the element to the singular.

I claim:

1. A water resistant aerator comprising:

an air inlet cover over an air inlet plate;

a top endbell attached to a top end of a stator shell;

a bottom endbell attached to a bottom end of the stator shell;

a motor enclosed by the top and bottom endbells and the stator shell;

a hollow rotor shaft mounted on a top bearing in the top endbell and a bottom bearing in the bottom endbell, wherein the rotor shall is coupled to the inlet plate at a first end, passes through the top endbell to the motor and from the motor through the bottom endbell where it is coupled to an aspirator shaft at a second end; and an air seal enclosure between the bottom endbell and the rotor shaft, wherein the water resistant aerator further comprises at least one waterproofing element selected from the group consisting of a top lip seal between the top endbell and the rotor shaft, the top lip seal being a single lip seal with at least 18 degrees of wear motion before pressure is lost, a grease seal between the top lip seal and the top bearing, a bottom lip seal between the bottom endbell and the rotor shaft, the bottom lip seal being a single lip seal with at least 18 degrees of wear motion before pressure is lost, and grease seal between a the bottom lip seal and the bottom bearing.

2. The water resistant aerator of claim 1, further comprising at least one O-ring seal located between an endbell and the stator shell.

3. The water resistant aerator of claim 1, further comprising:

a lifting handle coupling the rotor shaft to the air inlet plate, wherein the lifting handle includes a threaded attachment to the top endbell and the threaded attachment includes thread sealing compound.

4. The water resistant aerator of claim 1, further comprising:

a plurality of bolts securing a periphery of the top and bottom endbells to each other, wherein the bolts are located outside the stator shell.

5. The water resistant aerator of claim 1, wherein the top and bottom bearings are pre-lubricated sealed bearings having a running seal on either side.

6. The water resistant aerator of claim 1 further comprising:

the air inlet plate having openings with a combined cross-sectional area at least 4½ times larger than the cross-sectional area of the hollow portion of the rotor shaft.

7. The water resistant aerator of claim 1, further comprising:

the air inlet plate being located 1/16" below the air inlet cover.

8. A method of waterproofing a wastewater aerator, comprising:

providing an air inlet cover over an air inlet plate;

attaching a top endbell to a top end of a stator shell;

attaching a bottom endbell to a bottom end of the stator shell;

enclosing a motor with the top and bottom endbells and the stator shell;

mounting a hollow rotor shaft on a top bearing in the top endbell and a bottom bearing in the bottom endbell, and further coupling the rotor shaft to the inlet plate at a first end, passing the rotor shaft through the top endbell to the motor and from the motor through the bottom endbell where it is further coupled to an aspirator shaft at a second end; and providing an air seal enclosure between the bottom endbell and the rotor shaft, further comprising waterproofing the aerator by at least one methods from the group consisting of sealing the top endbell and the rotor shaft with a single lip seal with at least 18 degrees of wear motion before pressure is lost, sealing between the top lip seal and the top bearing with a grease seal, sealing between the bottom endbell and the rotor shaft with a single lip seal with at least 18 degrees of wear motion before pressure is lost, and sealing between a bottom lip seal and the bottom bearing with a grease seal.

9. The method of claim 8, further comprising:

providing at least one O-ring seal between an endbell and the stator shell.

10. The method of claim 8, further comprising:

coupling the rotor shaft to the air inlet plate with a lifting handle, further comprising attaching the lifting handle to the top endbell with a threaded attachment and sealing compound.

11. The method of claim 8, further comprising:

securing a periphery of the top and bottom endbells to each other with a plurality of bolts, wherein the bolts are located outside the stator shell.

12. The method of claim 8, further comprising:

providing pre-lubricated sealed bearings having a running seal on either side for the top and bottom bearings.

13. The method of claim 8, further comprising:

providing openings in the air inlet plate having a combined cross-sectional area at least 4½ times larger than the cross-sectional area of the hollow portion of the rotor shaft.

14. The method of claim 8, further comprising:

locating the air inlet plate 1/16" below the air inlet cover.

* * * * *